US005251413A

United States Patent [19]

Goodman

[11] Patent Number: 5,251,413

[45] Date of Patent: Oct. 12, 1993

[54] STABILIZED SPACE DIVIDING FRAMES AND PANELS

[75] Inventor: Steven F. Goodman, Wyoming, Mich.

[73] Assignee: Herman Miller, Inc., Zeeland, Mich.

[21] Appl. No.: 467,637

[22] Filed: Jan. 19, 1990

[51] Int. Cl.[5] ..... E04H 6/00

[52] U.S. Cl. ..... 52/239; 160/135

[58] Field of Search ..... 52/239, 28; 160/135, 160/351, 160

[56] References Cited

U.S. PATENT DOCUMENTS

| | | | |
|---|---|---|---|
| D. 42,180 | 2/1912 | Yesbera et al. . | |
| D. 59,053 | 9/1921 | Allen . | |
| D. 235,292 | 6/1975 | Podell . | |
| 375,006 | 12/1887 | Seavey . | |
| 554,864 | 2/1896 | Forbes et al. . | |
| 668,748 | 2/1901 | Buchanan . | |
| 830,943 | 9/1906 | Wessels . | |
| 1,067,291 | 7/1913 | Wilson . | |
| 1,324,537 | 12/1919 | Belcher . | |
| 1,673,105 | 6/1928 | Daugherty . | |
| 2,897,013 | 7/1959 | Delp . | |
| 3,158,265 | 11/1964 | Thimons . | |
| 3,232,370 | 2/1966 | Jaffe . | |
| 3,261,625 | 7/1966 | Cripe | 52/239 X |
| 3,312,025 | 4/1967 | Deakins | 52/239 |
| 3,405,985 | 10/1968 | Higer . | |
| 3,430,997 | 3/1969 | Propst et al. | 52/239 X |
| 3,605,851 | 9/1971 | Miles et al. | 52/239 X |
| 3,674,230 | 7/1972 | Propst . | |
| 3,762,116 | 10/1973 | Anderson et al. | 52/239 |
| 3,844,079 | 10/1974 | Karrip . | |
| 3,920,299 | 11/1975 | Propst et al. . | |
| 4,104,838 | 8/1978 | Hage et al. | 52/239 |
| 4,129,163 | 12/1978 | Johnson | 52/239 X |
| 4,205,815 | 6/1980 | Sauer et al. | 52/36 X |
| 4,356,672 | 11/1982 | Beckman et al. | 52/36 |
| 4,415,150 | 11/1983 | Iezza . | |
| 4,454,905 | 6/1984 | Banko, Jr. . | |
| 4,586,759 | 5/1986 | Wrobel . | |
| 4,638,614 | 1/1987 | Wilcox | 52/239 X |
| 4,655,019 | 4/1987 | Rejc | 52/239 X |
| 4,719,731 | 1/1988 | Ravotti et al.l | 52/239 |
| 4,794,744 | 1/1989 | Young et al. | 52/239 X |
| 4,821,788 | 4/1989 | Nelson | 52/239 X |
| 4,860,812 | 8/1989 | DePietro et al. | 52/239 X |
| 4,876,835 | 10/1989 | Kelley et al. | 52/239 |
| 4,914,878 | 4/1990 | Tamaki et al. | 52/36 X |
| 4,944,122 | 7/1990 | Wendt | 52/36 |

FOREIGN PATENT DOCUMENTS

| | | | |
|---|---|---|---|
| 949443 | 6/1974 | Canada | 160/135 |
| 545312 | 7/1922 | France | 52/281 |
| 0619278 | 9/1980 | Switzerland | 52/239 |
| 2184467 | 6/1987 | United Kingdom | 52/239 |
| 2204619 | 11/1988 | United Kingdom | 52/239 |

*Primary Examiner*—Carl D. Friedman
*Assistant Examiner*—Lan M. Mai
*Attorney, Agent, or Firm*—Varnum, Riddering, Schmidt & Howlett

[57] ABSTRACT

A space divider system comprising a pair of rigid rectangular frames rigidly secured to each other at their edges and modular components mounted to the frames. The bending moments of the modular components are opposed by a stabilizer that comprises a spacer having opposed outer faces that are flush with the outer face of the frames, a foot secured to a lower end of the spacer and extending outwardly therefrom in floor contacting relationship, and a brace secured to the foot and the spacer. The stabilizer is rigidly connected between the edges of the two adjacent frames.

14 Claims, 6 Drawing Sheets

STABILIZED SPACE DIVIDING FRAMES AND PANELS

BACKGROUND OF THE INVENTION

1. Field of the Invention

The invention relates generally to stabilized frames and panels for a modular space dividing system and, more particularly, to frames or panels having a stabilizer that can be mounted flush with the adjacent frames or panels so that modular components can be mounted flush to the panels and in continuous, uninterrupted fashion.

2. Description of the Related Art

The technique of erecting modular space dividing panels or partitions from which a variety of modular components may be suspended to create and define functional work areas has evolved over the past two decades. It is recognized that systems need to be rearrangeable so that work areas can be quickly modified to suit completely different tasks. Recent efforts have focused on designing components that are increasingly interchangeable, developing more efficient means of wire management, using lighter weight materials, ergonomics and aesthetics.

In its most fundamental aspects, the basic system comprises a plurality of modular space dividing panels or partitions arranged in angular and linear arrays to subdivide large open areas into smaller, more functional work spaces. Other panels extend normally from these panels to define individual work stations. Work surfaces, storage cabinets, and the like are suspended or cantilevered from the panels to complete the design.

In every system, it is necessary to brace or stabilize the space dividing panels to oppose the bending moments of the panels and the components suspended therefrom. An extended run of panels in a more or less linear arrangement requires other panels that project from the principal panels of the run at approximately right angles for support. These supporting panels, or panel returns, are secured to the panel run with panel to panel connectors. If a single supporting panel extends away from one side of a panel run, a T-shaped or three-way connector is utilized. If supporting panels extend away from opposite sides of a panel run, a four-way connector is required.

Despite the evolution of space management systems, several related problems have persisted, solutions for which have eluded designers and manufacturers. The first problem is that the panel to panel connectors which secure the panel returns to the panel run project outwardly relative to the panels being stabilized. Examples of these connectors are disclosed in U.S. Pat. Nos. 3,430,997, and 3,517,467 which issued, respectively, on Mar. 4, 1969 and, Jun. 30, 1975 to Herman Miller, Inc. Although the extent to which the connectors project outwardly is not substantial, it is sufficient to prohibit adjacent work surfaces or cable conduits from being mounted flush or closely adjacent to the panels or frames as well as to each other.

In the case of work surfaces, for example, surfaces adjacent to the connector would require a notched rear corner to accommodate the outwardly projecting connector. However, this notch greatly complicates mass production of the components. Similarly, if the work surfaces were mounted such that rear edges thereof were flush with the projection on the connector, a gap would exist between the rear edge of the work surface and the face of the space dividing panels. Small items such as pens, pencils, and paper clips as well as documents could fall through the gap to the floor below.

The second problem that has frustrated the modular office furniture industry is that the supporting panels or panel returns, even when only half-height relative to the panels being stabilized, interfere with the mounting of work surfaces and cable carrying conduits to the panels. Work surfaces and conduits must be interrupted to position a panel return. Work surfaces and conduits cannot be mounted flush to adjacent work surfaces and conduits. That is, an extended work surface or conduit mounted continuously and without interruption is not possible because of the three and four-way connectors used between the panels. When full-height panel returns are employed, work surfaces mounted to either side of the panel returns can not be arranged to provide a continuous uninterrupted surface. The return also obstructs and blocks convenient access from one work surface to the adjacent work surface.

One solution to the second problem has been the use of essentially floor level panel supporting brackets of a size and shape similar to conventional shelf brackets, an example of which is disclosed in U.S. Pat. No. 3,674,230, issued on Jul. 4, 1972 to R. L. Propst. However, this bracket is not appropriate for every installation depending on the length of the panel run, the height of the panels, and the weight and number of modular components cantilevered from the panels.

Thus, since the inception of space management systems some 20 years ago, there has existed a need for a stabilizer which is adaptable for use with a panel to panel connector, which does not project forwardly of the panels being stabilized, and further which is of a height that does not interfere with the continuous uninterrupted flush mounting of adjacent work surfaces and cable conduits. This need remains to be satisfied.

SUMMARY OF THE INVENTION

This invention relates generally to a modular space divider system comprising at least a pair of rigid rectangular frames and means for rigidly securing the frames together at their edges. The space divider system further includes means for mounting modular components such as work surfaces, storage cabinets and the like to the frames and means for stabilizing the frames against the bending moments of the modular components mounted to the frames. More particularly, the invention relates to an improvement in the stabilizing means. The improvement comprises a spacer having opposed outer faces that are flush, or aligned with, the faces of the frames and coextensive with the bottom portion of the frame, a foot that is rigidly secured to a lower end of the spacer and which extends outwardly from at least one face of the spacer in floor contacting relationship, a brace that is secured to the foot and the spacer to rigidly brace the foot and the spacer against the bending moments of the modular components, and means for rigidly connecting the spacer between the edges of the two adjacent frames.

The space divider system can include vertical hanging intelligence for mounting the modular components to the frames and wedge blocks for connecting the spacer between the two rectangular frames.

In various embodiments, the foot can extend outwardly from one face of the spacer or from opposing faces and can extend outwardly beyond the brace or be essentially co-extensive with the outward position of the brace relative to the spacer.

In one embodiment of the invention, a pair of work surfaces can be mounted to the frames, one of the work surfaces having a portion that extends beyond the spacer such that adjacent side edges of the work surfaces are in a flush relation. The rear edges of the work surfaces are closely adjacent to the rectangular frames or to a decorative facia secured to the frames if such is provided. In another embodiment, the space divider system can include wire management means mounted to the frames, the wire management means having a portion extending beyond the spacer such that the wire management means is substantially continuous. A rear edge of the wire management means is mounted closely adjacent to the frames or to decorative facia secured to the frames if such is provided.

BRIEF DESCRIPTION OF THE DRAWINGS

The invention will now be described with reference to the drawings in which.

DETAILED DESCRIPTION OF THE PREFERRED EMBODIMENTS

Figure 1A:
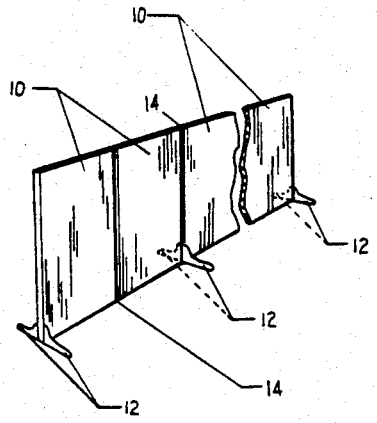
FIG. 1A PRIOR ART
FIG. 1A is a perspective view of a prior art space management system in which partitions are stabilized by support legs.

Turning now to the drawings, FIGS. 1A to 1G disclose various prior art structures and assemblies, the deficiencies of which, as explained hereinabove in the Background and as further explained below, the invention is intended to overcome. FIG. 1A illustrates a prior art system in which a plurality of space dividing panels or partitions 10 having faces **10*a* are arranged in a linear array to provide an extended run of panels or a panel run. The partitions 10 are braced by support legs 12 which can be seen as extending away from both sides of the panel run at approximately right angles. The legs 12 are secured to a connector 14 for the panel 10 through a single screw at the bottom of the connector. A support leg of the type illustrated in FIG. 1A is disclosed in the above mentioned U.S. Pat. No. 3,674,230. Although the support legs 12** are quite functional in certain installations, they may not be appropriate in all situations, depending on the length of the panel run and the size, weight and number of modular components suspended from the panels.

Figure 1B:
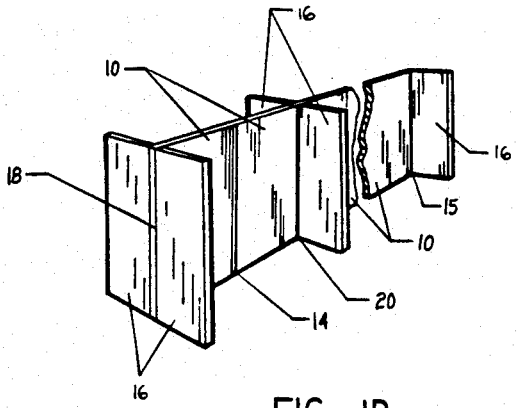
FIG. 1B PRIOR ART
FIG. 1B is a perspective view of a second prior art space management system in which partitions are stabilized by panel returns as high as the partitions.

FIG. 1B discloses a prior art space management system in which a plurality of space dividing panels or partitions 10 in a linear array are braced or stabilized by a plurality of panel returns 16 extending away from both sides of the panel run, the panel returns being as high as the panel run. When high panel returns 16 are employed, it is not possible to mount work surfaces or cable conduits (not shown separately in the drawings) continuously without interruption because the panel returns disrupt the mounting surface. The panel returns 16 obstruct access from one work surface to an adjacent work surface. The panel returns 16 are secured to the panels 10 by two-, three-, and four-way connectors 15, 18, and 20, respectively.

Figure 1C:
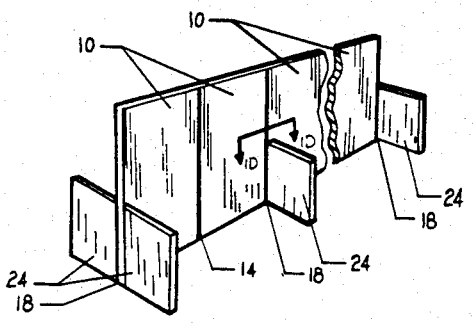
FIG. 1C PRIOR ART
FIG. 1C is a perspective view of a third prior art space management system in which partitions are stabilized by panel returns that are not as high as the partitions.

FIG. 1C discloses a prior art space management system in which a plurality of space dividing panels 10 in a linear array are braced or stabilized by a plurality of panel returns 24 that are not as high as the panel run. As in FIG. 1B, the panel returns 24 can be secured to the panels 10 by two-, three-, and four-way connectors 15, 18, and 20.

Figure 1D:
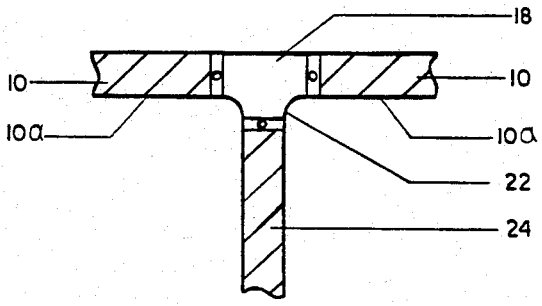
FIG. 1D PRIOR ART
FIG. 1D is a sectional view taken along lines 1D—1D of FIG. 1C.

FIG. 1D is a sectional view taken along lines 1D—1D of FIG. 1C and illustrates how the three-way panel to panel connector 18 extends outwardly at 22 relative to the adjacent panel face **10*a*. The extension 22 interferes with the mounting of work surfaces and cable conduits to the panels as explained in the Background. The work surface, to be flush with the panel face, must be notched to accommodate the extension 22. Alternatively, the work surface or conduits must be mounted away from the panel 10 so as to be flush with the extension 22**, thereby creating a gap between the rear edge of the work surface and the panel. Neither situation is desirable.

Figure 1E:
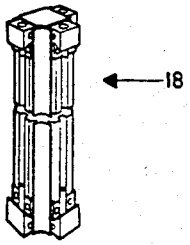
FIG. 1E PRIOR ART
FIG. 1E is a perspective view of a prior art three-way panel to panel connector.
Figure 1F:
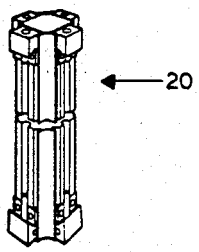
FIG. 1F PRIOR ART
FIG. 1F is a perspective view of a prior art four-way panel to panel connector.
Figure 1G:
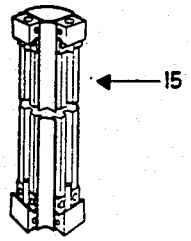
FIG. 1G PRIOR ART
FIG. 1G is a perspective view of a prior art two-way panel to panel connector.

FIGS. 1G, 1E, and 1F are perspective views, respectively, of the prior art two-, three- and four-way panel to panel connector, 15, 18 and 20. The two-way connector 15 is used when a panel return 16 is connected to a panel at a right angle thereto. The three-way connector 18, as shown above, is employed to secure a panel return 16 or 24 when it is desired to brace the panel run on only one side. The four-way connector would be used when it is necessary to support a run of panels on both sides.

Figure 2A:
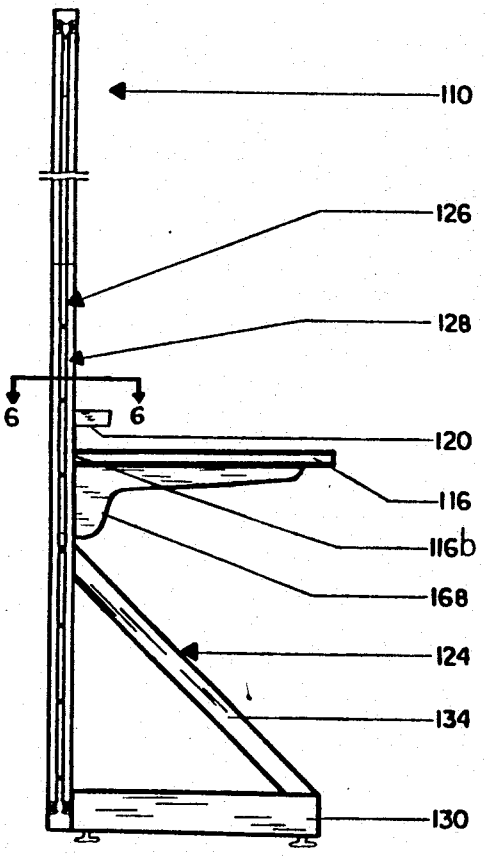
FIG. 2A is a longitudinal sectional view of the space dividing panels, stabilizer, work surfaces and wire management means of FIG. 2 taken along lines 2A—2A of FIG. 2.
Figure 2:
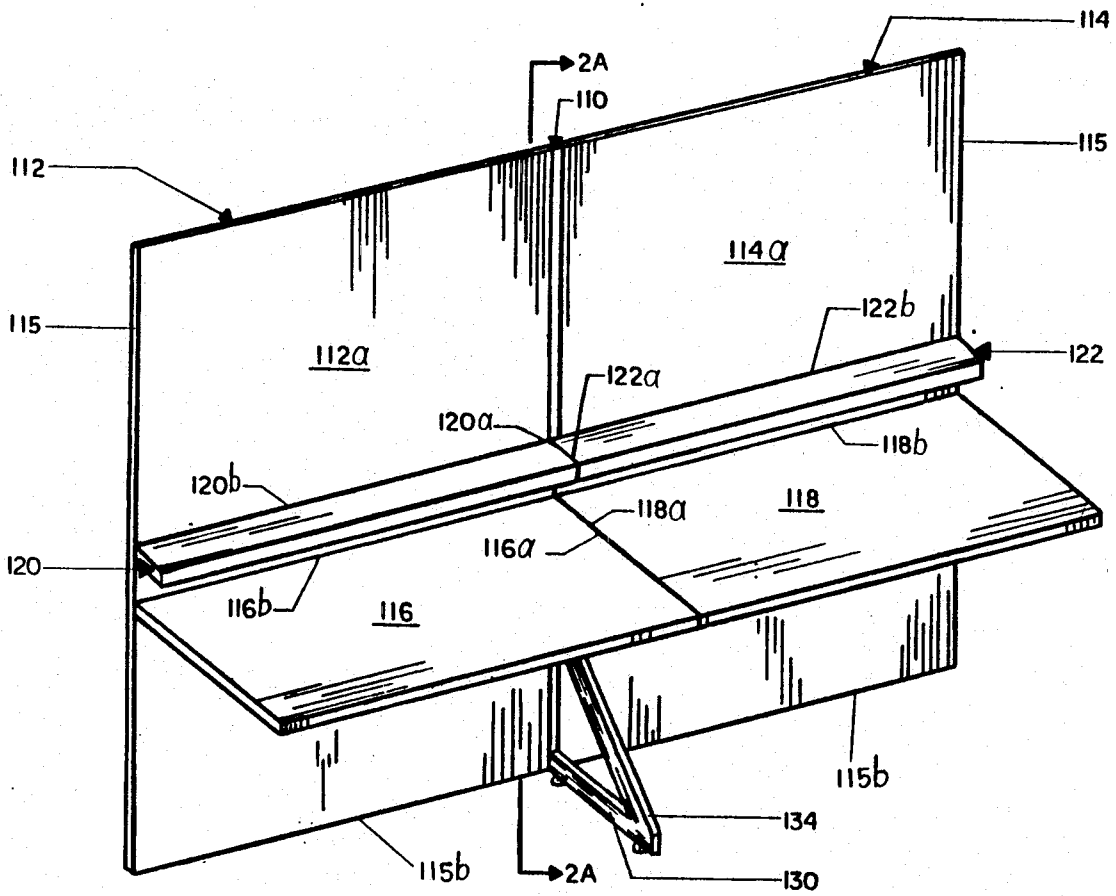
FIG. 2 is a perspective view of two modular space dividing panels braced by a stabilizer according to the invention and showing wire management means and work surfaces mounted flush to the panels in continuous, uninterrupted fashion.
Figure 3:
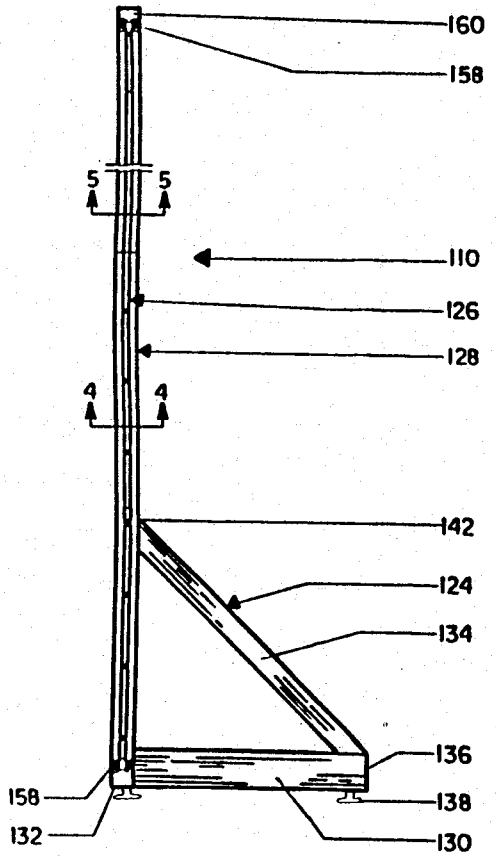
FIG. 3 is an elevational view of the stabilizer shown in FIGS. 2 and 2A.

Turning now to the drawings illustrating the invention, and in particular FIGS. 2 and 2A, a pair of adjacent space dividing panels or partitions 112 and 114 are rigidly connected to a stabilizer 110 therebetween. Cantilevered from the wall panels 112 and 114 are adjacent work surfaces 116 and 118, and wire management means, which is shown in the form of adjacent cable carrying conduits 120 and 122. It should be noted that the work surfaces 116 and 118 are mounted such that adjacent side edges thereof 116*a*, 118*a*, respectively, are flush or closely adjacent. Similarly, the cable carrying conduits 120 and 122 are mounted such that their adjacent side edges 120*a*, 122*a*, respectively, are flush, thereby providing a continuous uninterrupted channel in which cables may be arranged. Rear edges 116*b* and 118*b* of the work surfaces 116 and 118, respectively, and rear edges 120*b* and 122*b* of the conduits 120 and 122, respectively, are closely adjacent to panel faces 112*a* and 114*a*.

Although the stabilizer 110 is shown in conjunction with only the two space dividing panels 112 and 114, it should be understood that the drawing only illustrates the function of the stabilizer. In a typical installation, there would be more than two space dividing panels arranged in a linear or angular array thereby creating what may be referred to as an extended run of panels or a panel run. The stabilizer 110 is installed periodically along the length of the panel run to brace and support the run. The number of stabilizers required in a particular situation will depend upon several factors including the length of the panel run, whether the panel run is stabilized or supported by other structural elements (such as other space dividing panels that extend normally from the panel run), and the type of modular components that are mounted to the panels.

The space dividing panels or partitions 112, 114 can be in any of the forms well known in the art but it is expected that the panels will generally comprise rigid rectangular frames 115 having face portions 115*a* and bottom portion 115*b*. To provide the panels 112, 114 the frames may be finished on opposite sides with a decorative facia such as a fabric coordinated to aesthetically blend with the surrounding furnishings and may also include decorative plastic trim elements (not shown separately in the drawings) at upper and lower portions of the panel. Although not specifically illustrated in the drawings, the frame 115 can be left unfinished so as to provide an open framework, such a structure being desirable in certain situations, for example a laboratory work station or the like.

Turning now to FIGS. 3 to 6, the stabilizer 110 comprises means for stabilizing the modular space dividing panels to oppose the bending moments of the frames 115 and components mounted to the frames, which means is shown in the form of a panel return 124. The stabilizer 110 further includes means for mounting components or accessories to the stabilizer, which means is shown as a hanger frame 126 having vertical hanging intelligence as explained below. Accessories or components which can be mounted to the frames 115 by way of the hanger frame 126 include the work surfaces 116, 118 and the cable conduits 120, 122 as well as storage cabinets and the like.

The panel return 124 comprises a spacer 128 having outer flat faces or sides 128*a*, 128*b*, 128*c* and 128*d* and a foot or supporting member 130 rigidly secured to a lower end 132 of the spacer and extending normally or outwardly from a face thereof. An angular brace 134 inclines from a distal end 136 of the foot 130 to the spacer 128 and, as explained below, stabilizes the spacer against the bending moments of the components mounted to the frames above the brace. Preferably, the spacer 128, the foot 130, and the brace 134 are formed from steel tubing and are welded to each other to provide a rigid structure. A lower surface of the foot may be provided with a threaded opening (not shown separately in the drawings) for receiving a height adjustable glide 138 for resting on a floor surface.

Figure 7:
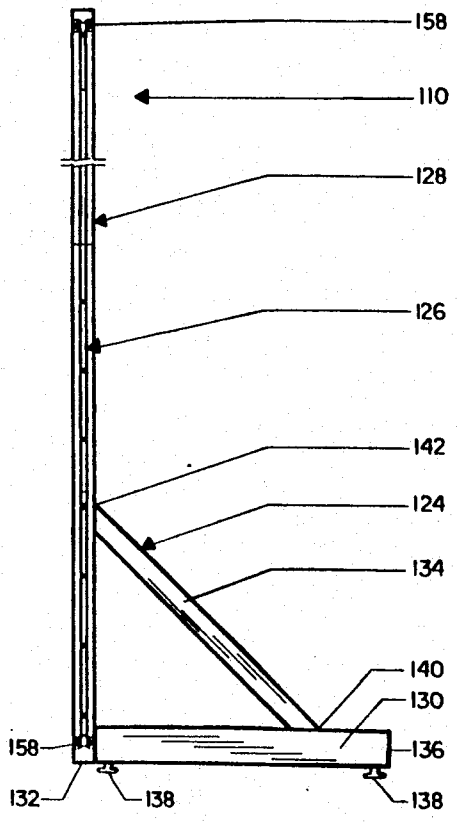
FIG. 7 is an elevational view of a second embodiment of the stabilizer.

In a second embodiment, which is shown in FIG. 7, the brace 134 rather than being essentially coextensive with the foot 130 in an outward position relative to the spacer 128, is connected to the foot 130 at a point 140 slightly inwardly of the foot distal end 136. That is, the foot 130 extends outwardly beyond the brace 134. In either embodiment, it is preferred that the brace 134 connect to the spacer 128 at a point 142 approximately 22" above the lower end 132 of the spacer so that the brace does not interfere with work surfaces mounted to the space dividing panels.

Figure 4:
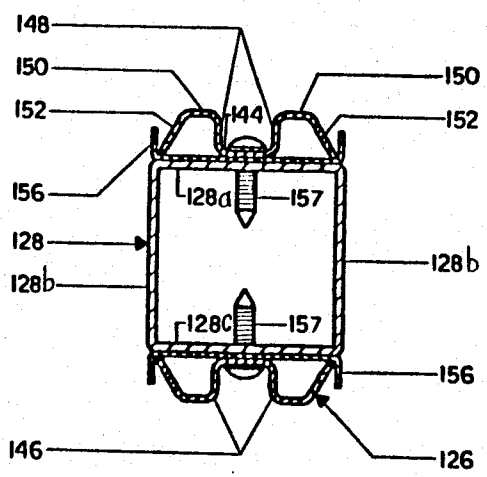
FIG. 4 is a sectional view taken along lines 4—4 of FIG. 3.
Figure 5:
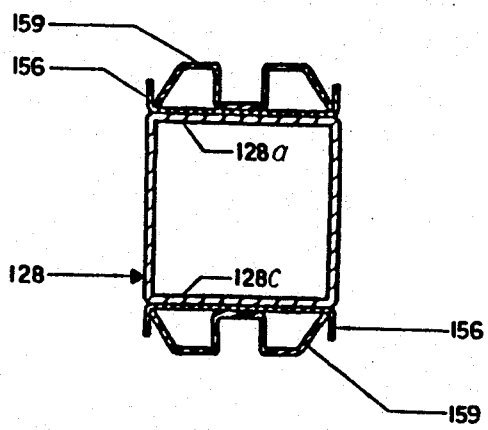
FIG. 5 is a sectional view taken along lines 5—5 of FIG. 3.

The hanger frame 126 is best shown in FIG. 4 and comprises a central right angle U-shaped portion 144. Integral with a distal end 146 of each U-leg 148 is a flat section 150 which, in turn, is integral with an angled leg 152. A plurality of vertically elongated slots 154 (FIG. 6) are formed in each angled leg 152 and provide the vertical hanging intelligence. A right angle U-shaped shell or retainer member 156 captures the ends of the angled legs 152 between the legs of the retainer member. The hanger frame 126 is essentially the same in outward configuration as the hanger frames disclosed in U.S. Pat. No. 3,430,997.

In assembly, the shell 156 and the hanger frame 126 are secured to opposite faces 128*a* and 128*c* of the spacer 128, for example by screws 157 that register with openings in the shell, the hanger frame, and the spacer, the openings not being shown separately in the drawings. The shell 156 is oriented to open outwardly and the hanger frame 126 is positioned such that the angled legs 152 are inwardly directed and retained by the shell 156. Because the hanger frame 126 need not extend the entire height of the spacer 128, the remaining space may be occupied by filler tape 159 having a shape similar to that of the hanger frame.

Figure 6:
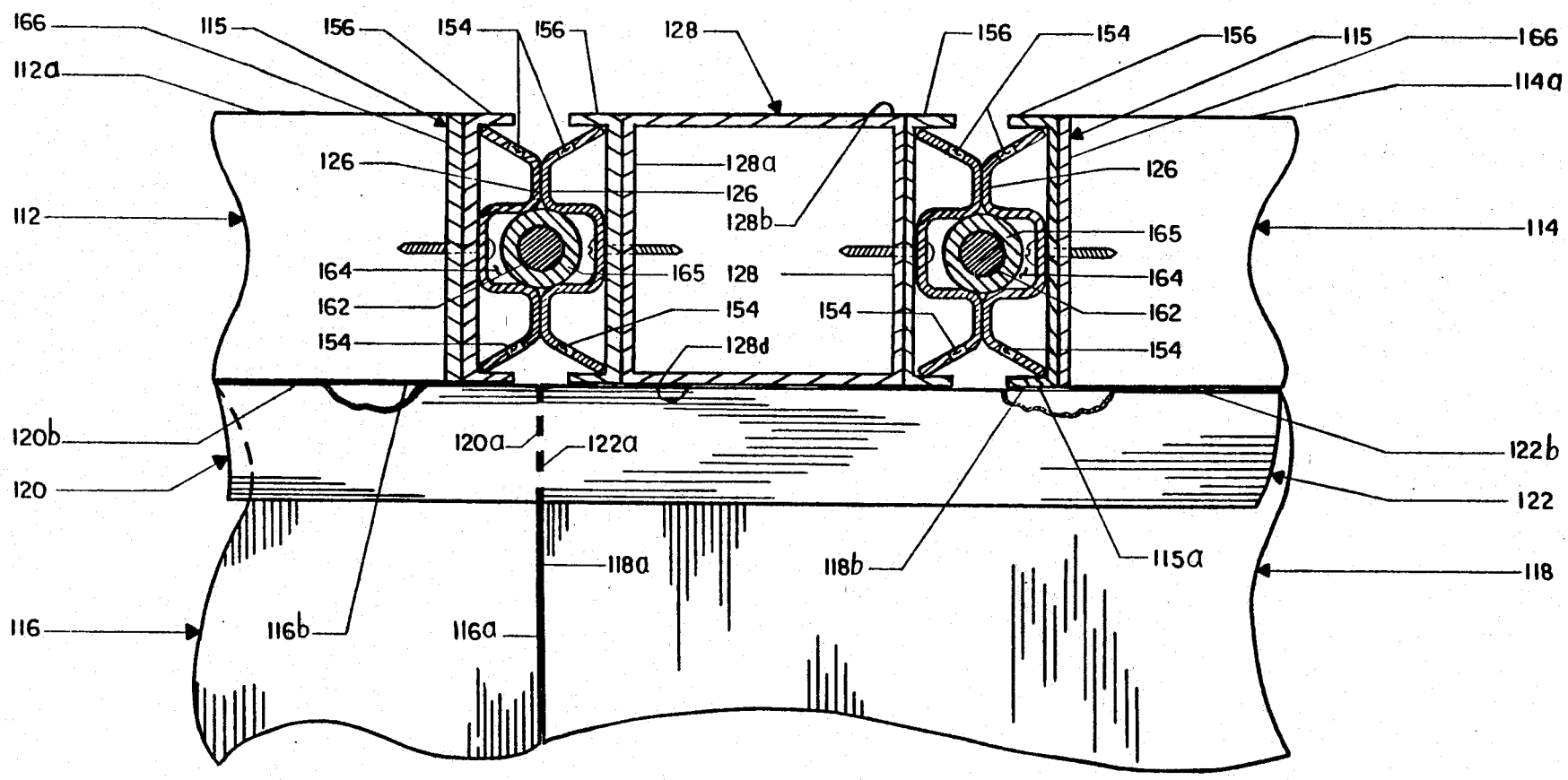
FIG. 6 is a sectional view taken along lines 6—6 of FIG. 2A.
Figure 10:
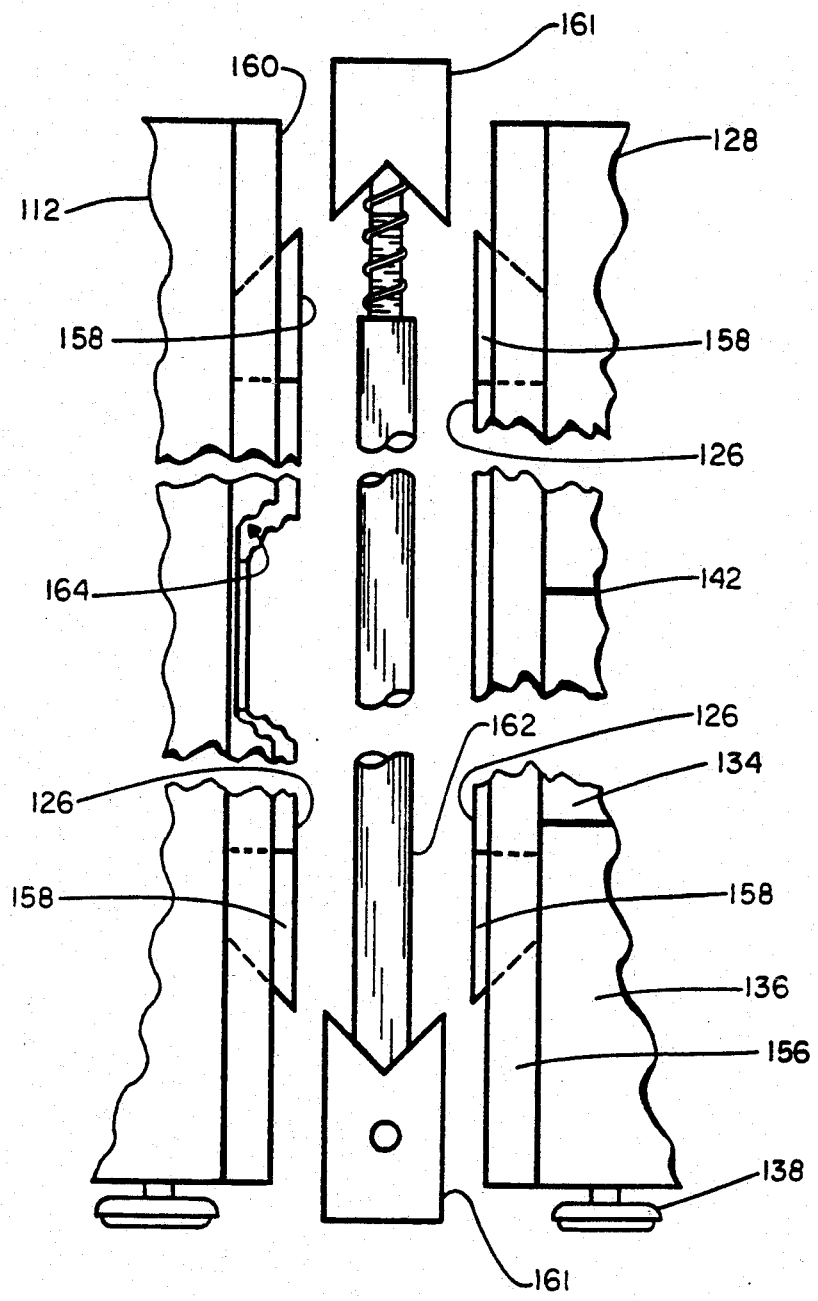
FIG. 10 is an elevational view of the wedge block and draw block panel connectors used to connect the panels to the stabilizers.

Once so assembled, the stabilizer 110 may be rigidly connected between the frames 115 of the two adjacent panels or partitions 112, 114 by use of wedge and draw block assemblies, it being understood that the stabilizer also functions as a panel to panel connector. Wedge and draw block assemblies are fully disclosed in U.S. Pat. No. 3,430,997, which patent is hereby incorporated by reference. FIG. 10 shows the wedge block 158 and draw block 161 panel connectors. In general, a wedge block 158 is mounted to an upper end 160 and the lower end 132 of the spacer 128 and to the same faces 128*a*, 128*c* to which the hanger frames 126 are secured. As best shown in FIG. 6, complementary wedge blocks 161 are secured to a facing edge 166 of the rectangular frame 115 of the partition to which the stabilizer 110 is to be secured. The facing edge 166 is provided with a hanger frame similar to that described above. A tie rod or connector 162 is received in a channular recess 164 established by the engagement of the pair of facing hanger frames. The tie rod 162 has a hollow cylindrical sleeve 165 received over and welded to the tie rod. The sleeve 165 fills channular recess 164, whereby adjacent partitions share the loads to which that stabilizer 110 is subjected. Upper and lower ends of the tie rod 162 are provided with draw blocks that are adapted to mate with the wedge blocks 158. The longitudinal positions of the draw blocks are adjustable to tightly engage the draw blocks with the wedge blocks thereby rigidly connecting the stabilizer 110 to the panels or partitions 112 and 114.

Still referring to FIG. 6, the panel frames 115 are secured to opposite faces 128*a*, 128*c* of the spacer 128, the stabilizer serving as a panel to panel connector. Adjacent panels or frames not connected by a stabilizer according to the invention may be rigidly secured at their edges by hanger frames and wedge and draw block assemblies analogous to these described above, the hanger frames and wedge blocks being secured to the facing edge portions of the panels or partitions and joined by the draw blocks and the tie rod. Once the panel frames 115 and stabilizer 110 have been so assembled, hanging modular components such as the work surfaces 116, 118 and the cable carrying conduits 120, 122 may be suspended from the hanger frames 126 by way of the hanging vertical intelligence in a manner well known in the art and also disclosed in the above incorporated U.S. Pat. No. 3,430,997. For example, the work surfaces can be supported by generally L-shaped brackets 168 (FIG. 2A) that have hooks which register with the slots 154 in the hanger frame 126.

Figure 9:
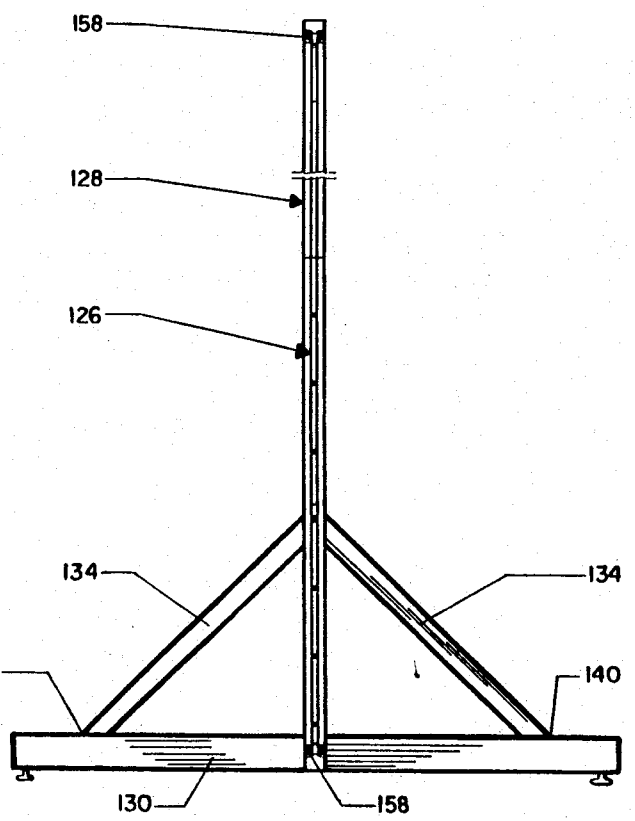
FIG. 9 is an elevational view of a fourth embodiment of the stabilizer.
Figure 8:
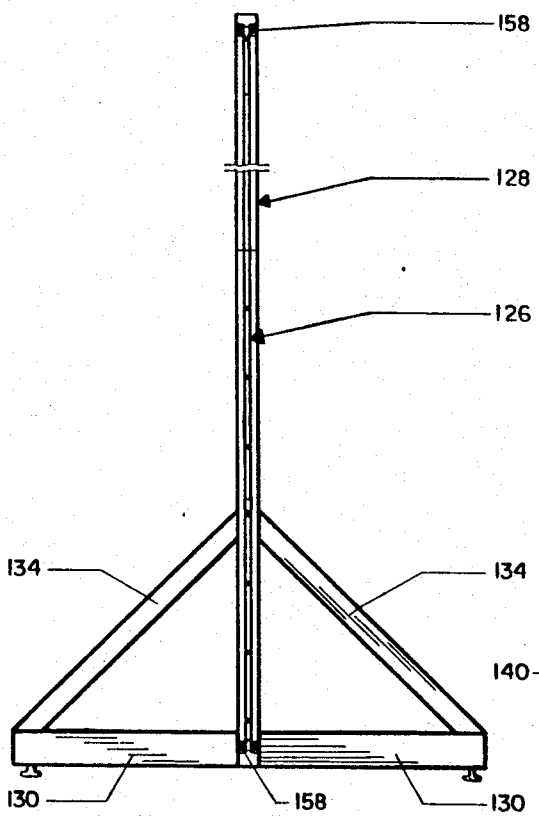
FIG. 8 is an elevation view of a third embodiment of the stabilizer.

In FIG. 8, there is shown a third embodiment of the stabilizer which is substantially similar to the embodiment shown in FIGS. 3 to 6 except that a foot 130 extends in opposite directions from opposing faces of the spacer 128, each foot being further connected to the spacer by the brace 134. Similarly, FIG. 9 discloses an embodiment like that shown in FIG. 7, except that the brace 134 inclines from a point 140 spaced inwardly from a distal end 136 of each foot 130. The embodiments shown in FIGS. 8 and 9 are useful when the space dividing panels divide an otherwise open area and it is desired to mount work accessories to both faces of the panels. The embodiments shown in FIGS. 3 to 7 are most useful when it is desired to mount work accessories to only one face of the panels, the stabilizers of course being positioned to brace that side of the panels to which the accessories are mounted.

It is expected that the overall height of the stabilizer 110 (not including the glides 138) will conform to the height of the space dividing panels 112, 114, such panels typically having heights of approximately 48" and 80" which are commonly referred to as half height and full height panels, respectively.

Because the brace 134 is secured to the spacer 128 at a point approximately 22" above the lower end 132 of the spacer, and thus approximately 22" above the floor or supporting surface (not shown separately in the drawings), the brace does not interfere with the mounting or use of the work surfaces 116, 118, which typically are installed at a height at least 30" above the floor.

The spacer 128 has opposing faces 128*b* and 128*d* that are flush with the faces 112*a* and 114*a* of the space dividing panels 112 and 114 and the face portions 115*a* of the frames 115 (FIG. 6). That is, the spacer faces 128*b* and 128*d* lie in the same plane as faces 112*a* and 114*a* of the panels 112 and 114. The spacer 128 is also coextensive with the bottom portion 115*b* of the frame 115. As described hereinabove, those three- and four-way connectors which are presently known have an asymmetrical configuration with a projection 22 that extends beyond or outwardly of the faces 10*a* of the space dividing panels 10. Thus, when these connectors are used, work surfaces and conduits cannot be mounted flush to the panels without the provision of a notch to accommodate the outwardly extending projection of the connectors. If the work surfaces or cable conduits are mounted flush with the projection, a space or gap between the rear edge of the work surface or conduit and the panel face is created. Similarly, the work surfaces or conduits cannot be conveniently mounted so as to be flush with adjacent work surfaces or conduit sections.

However, as best shown in FIG. 6, with a stabilizer according to the invention, the opposed faces 128*b* and 128*d* of the spacer 128 are flush with the faces 112*a* and 114*a* of the space dividing panels 112 and 114 and the frames 115 thereof. There is no projection that extends beyond or outwardly of the panels to interfere with the flush mounting of work surfaces 116, 118 or cable carrying conduits 120, 122 to the panels. Rear edges 116*b*, 118*b*, 120*b*, and 122*b* of the work surfaces 116, 118 and the cable conduits 120, 122 are flush with or closely adjacent to the face portions 115*a* of rigid rectangular frames 115 and the fabric facia (if such be provided) of the panels 112, 114. Thus, in addition to providing a means for bracing the modular space dividing panels, the stabilizer allows for the mounting of adjacent accessories flush to the panels. Similarly, side edges 116*a* and 118*a*, respectively of the work surfaces 116 and 118, can easily be mounted closely adjacent or closely spaced to the side edges of adjacent conduits. Side edges 118*a* and 120*a*, respectively of the conduits 118 and 120, can easily be mounted flush to the side edges of adjacent work surfaces. One of the work surfaces or conduits need only be constructed so as to extend beyond or in front of the spacer to abut or be closely adjacent to the next adjacent work surface or conduit. Thus work surfaces or conduits can be mounted flush or closely adjacent to the space dividing panels or frames as well as flush or closely adjacent to each other to provide a continuous, uninterrupted surface or conduit.

Reasonable variations or modifications are possible with the spirit of the foregoing specification and drawings without departing from the scope of the invention which is defined in the accompanying claims.

I claim:

1. A space divider system, comprising:

at least two adjacent rigid rectangular frames, said frames having edge portions, bottom portions and face portions;

means for rigidly securing said frames together at the edge portions;

means for mounting modular components such as work surfaces, storage cabinets and the like to said frames; and means for stabilizing said frames to oppose the bending moments of said modular components mounted to said frames;

wherein the improvement in said stabilizing means comprises:

a spacer having opposed outer faces flush with the face portions of said frames and substantially coextensive with a bottom portion thereof;

a foot rigidly secured to a lower end of said spacer and extending outwardly from at least one face thereof;

a brace secured to said foot and to said spacer at a location above said foot, the length of the foot and the location of the brace on the spacer being selected to effectively rigidly brace said spacer against the bending moments from said modular components mounted to said frames above said braces; and means for rigidly connecting said spacer between said at least two adjacent frames at the edge portions thereof.

2. A space divider system according to claim 1 wherein said connecting means is mounted to the sides of the spacer and between said spacer and the two adjacent frames.

3. A space divider system according to claim 2 wherein said connecting means further comprises vertical hanging intelligence for mounting said modular components to said frames.

4. A space divider system according to claim 2 wherein said connecting means includes an upper portion, a lower portion and wedge blocks mounted to the upper and lower portions of the connecting means.

5. A space divider system according to claim 4 wherein said space divider system further comprises at least two work surfaces mounted to said frames, said work surfaces having adjacent side edges and further wherein one of said work surfaces has a portion extending beyond said spacer whereby the side edges of said work surfaces are in a closely spaced relationship.

6. A space divider system according to claim 4 wherein said space divider system further comprises means for wire management mounted to said frames, said wire management means having a portion extending beyond said spacer whereby said wire management means is substantially continuous.

7. A space divider system according to claim 1 wherein said foot extends outwardly from opposing faces of said spacer.

8. A space divider system according to claim 1 wherein said foot extends outwardly beyond said brace.

9. A space divider system according to claim 1 wherein said foot and said brace are essentially coextensive in outward position relative to said spacer.

10. A space divider system according to claim 1 wherein said frames further include a decorative facia.

11. A space divider system according to claim 10 wherein said space divider system further comprises means for wire management mounted to said frames, said wire management means having a rear edge and a portion extending beyond said spacer whereby said wire management means is substantially continuous and the rear edge is closely adjacent to the decorative facia.

12. A space divider system according to claim 10 wherein said space divider system further comprises at least two work surfaces mounted to said frames, said work surfaces having rear edges and adjacent side edges and further wherein one of said work surfaces has a portion extending beyond said spacer whereby the side edges are in a closely spaced relation to each other and the rear edges are closely adjacent to the decorative facia.

13. A space divider system, comprising:

at least two adjacent rigid rectangular frames, said frames having edge portions and face portions;

means for rigidly securing said frames together at the edge portions;

means for mounting modular components such as work surfaces, storage cabinets and the like to said frames; and means for stabilizing said frames to oppose the bending moments of said modular components mounted to said frames;

the improvement which comprises:

said stabilizing means comprising:

a spacer having opposed outer faces flush with the face portions of said frames;

a foot rigidly secured to a lower end of said spacer and extending outwardly from at least one face thereof;

a brace secured to said foot and to said spacer at a location above said foot, the length of the foot and the location of the brace on the spacer being selected to effectively rigidly brace said spacer against the bending moments from said modular components mounted to said frames above said braces; and means for rigidly connecting said spacer between said at least two adjacent frames at the edge portions thereof; and at least two work surfaces mounted to said frames, said work surfaces having adjacent side edges, wherein one of said work surfaces has a portion extending beyond said spacer whereby said side edges of said work surfaces are in closely spaced relation.

14. A space divider system, comprising:

at least two adjacent rigid rectangular frames, said frames having edge portions and face portions;

means for rigidly securing said frames together at the edge portions;

means for mounting modular components such as work surfaces, storage cabinets and the like to said frames; and means for stabilizing said frames to oppose the bending moments of said modular components mounted to said frames;

the improvement which comprises:

said stabilizing means comprising:

a spacer having opposed outer faces flush with the face portions of said frames;

a foot rigidly secured to a lower end of said spacer and extending outwardly from at least one face thereof;

a brace secured to said foot and to said spacer at a location above said foot, the length of the foot and the location of the brace on the spacer being selected to effectively rigidly brace said spacer against the bending moments from said modular components mounted to said frames above said braces;

means for rigidly connecting said spacer between said at least two adjacent frames at the edge portions thereof; and wire management conduits mounted to said frames, said wire management conduits having a portion extending beyond said spacer, whereby said wire management conduits are substantially continuous.

* * * * *